US005778792A

United States Patent [19]

Lu

[11] Patent Number: 5,778,792

[45] Date of Patent: Jul. 14, 1998

[54] METHOD FOR FORMING A PATTERN ON A SURFACE OF AN ALUMINUM EXTRUSION

[76] Inventor: Tsung-Tai Lu, No. 499, Chiu-Ju Erh Rd., Kaohsiung City, Taiwan

[21] Appl. No.: 850,899

[22] Filed: May 2, 1997

[51] Int. Cl.[6] ..... B05D 7/00; B05D 3/00; B05D 5/00

[52] U.S. Cl. ..... 101/483; 427/267; 427/280; 427/409; 427/195

[58] Field of Search ..... 101/483, 34, 35; 427/267, 280, 287, 409, 202, 203, 388.1, 195, 209, 327, 437, 443.1, 511

[56] References Cited

U.S. PATENT DOCUMENTS

| | | | |
|---|---|---|---|
| 4,210,695 | 7/1980 | Hirono et al. | 428/209 |
| 4,690,715 | 9/1987 | Allara et al. | 427/305 |
| 5,089,313 | 2/1992 | Cope | 428/151 |
| 5,565,260 | 10/1996 | Hawk | 428/195 |
| 5,571,562 | 11/1996 | Wakat | 427/280 |

*Primary Examiner*—Edgar S. Burr
*Assistant Examiner*—Dave A. Ghatt
*Attorney, Agent, or Firm*—Skjerven Morrill MacPherson Franklin & Friel LLP; Thomas S. MacDonald

[57] ABSTRACT

A method for forming a pattern on the surface of an aluminum extrusion comprises the steps of cleaning the surface of the aluminum extrusion; forming a film on the cleaned surface of the aluminum extrusion; providing a base color coating on the surface of the aluminum extrusion; baking the aluminum extrusion at a temperature of 150°–300° C.; washing the surface of the aluminum extrusion with an organic solvent; printing the pattern onto the base color coating by means of a power-driven metal roller which has the pattern formed on an external face thereof and which has ink provided thereon, and a polyurethane roller which contacts rotatably the external face of the metal roller and the base color coating of the aluminum extrusion for transfer printing the pattern from the metal roller to the base color coating of the aluminum extrusion; and forming a transparent protective film on the printed surface of the aluminum extrusion.

13 Claims, 2 Drawing Sheets

METHOD FOR FORMING A PATTERN ON A SURFACE OF AN ALUMINUM EXTRUSION

BACKGROUND OF THE INVENTION

1. Field of the Invention

This invention relates to a method for forming a pattern on a surface of an aluminum extrusion.

2. Description of the Related Art

Aluminum extrusions are widely used in the architecture industry. However, since the aluminum extrusion has a monochromatic surface, the appearance thereof is dull and lacks aesthetic appeal.

SUMMARY OF THE INVENTION

It is therefore a main object of the present invention to provide a method for forming a pattern on the surface of an aluminum extrusion in order to improve the appearance thereof.

According to the present invention, the method for forming a pattern on the surface of an aluminum extrusion comprises the steps of:

- cleaning the surface of the aluminum extrusion by degreasing, caustic washing and pickling the aluminum extrusion;
- forming a film on the cleaned surface of the aluminum extrusion;
- providing a base color coating on the surface of the aluminum extrusion;
- baking the aluminum extrusion at a temperature of 150°–300° C. in order to crosslink and harden the base color coating;
- washing the base color coating with an organic solvent in order to remove oil stains and dust;
- printing the pattern onto base color coating of the aluminum extrusion by means of a power-driven metal roller which has the pattern formed on an external face thereof and which has ink provided thereon, and a polyurethane roller which contacts rotatably the external face of the metal roller and the base color coating of the aluminum extrusion for transfer printing the pattern from the metal roller to the base color coating of the aluminum extrusion; and
- forming a transparent protective film on the printed surface of the aluminum extrusion.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
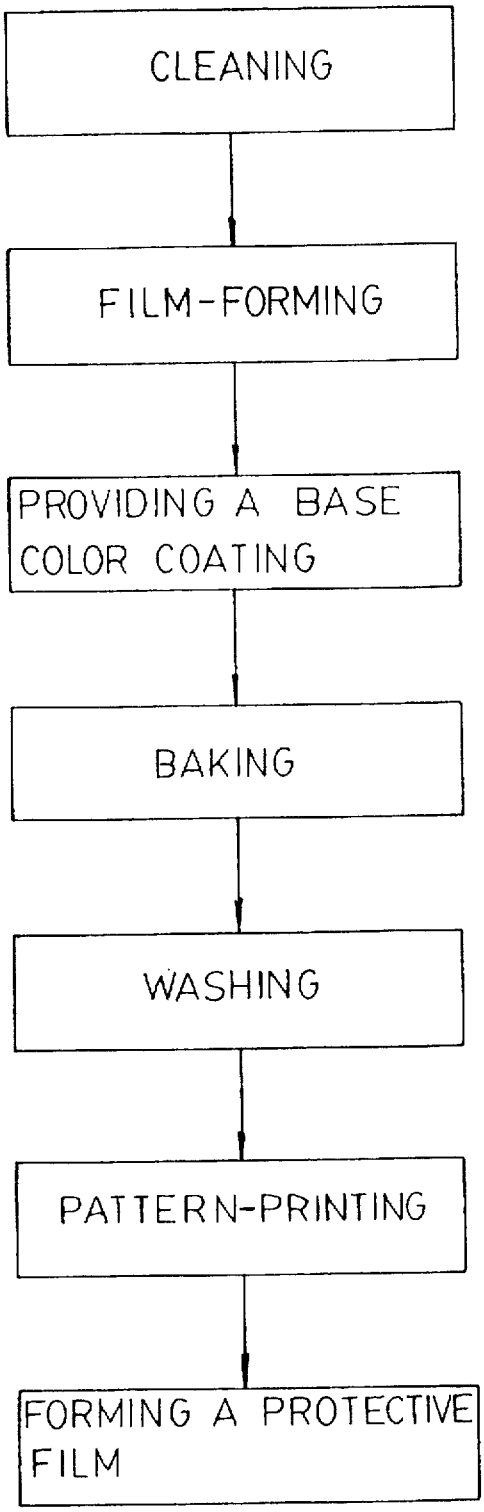
FIG. 1 is a flow diagram showing the method for forming a pattern on a surface of an aluminum extrusion according to the present invention.

Referring to FIG. 1, a preferred embodiment of the method for forming a pattern on a surface of an aluminum extrusion in accordance with the present invention is shown to comprise the steps of cleaning, film-forming, providing a base color coating, baking, washing, pattern-printing, and forming a protective film. In this embodiment, the pattern is in the form wood grains. The steps of the method for forming the pattern on the surface of the aluminum extrusion may be carried out right after the steps of the method for forming the aluminum extrusion in order to form and process the aluminum extrusion continuously. In addition, the method of the present invention can be performed a continuously on a conveyor device.

The cleaning step includes the step of dipping sequentially the aluminum extrusion into washing tanks which contain a surface-active agent, 1–50% of sodium hydroxide and 15–30% of nitric acid, respectively, in order to remove grease from the surface of the aluminum extrusion.

The cleaned aluminum extrusion is electrolyzed in a sulfuric acid solution in order to form an oxide film. The sulfuric acid solution contains sulfuric acid having a concentration of 50–250 g/l, an aluminum ion concentration of 2–50 g/l, an electrolysis temperature of 10°–30° C., an electrolysis voltage of 5–25 volts, and an electric current density of 50–300 A/m$^2$. The function of the oxide film is to provide a weather-proof effect to the aluminum extrusion.

A base color coating is provided on the film at the surface of the aluminum extrusion by electrodepositing an acrylic electrodeposition coating of a base color on the surface of the aluminum extrusion at a temperature of 0°–50° C. The concentration of the electrodeposition coating is 1–25 wt %. The base color coating can improve the appearance of the aluminum extrusion and protect the aluminum extrusion.

The aluminum extrusion is then baked at a temperature of 150°–300° C. in order to crosslink and harden the base color coating.

Next, the base color coating of the aluminum extrusion is washed by an organic solvent in order to remove oil stains and dust therefrom.

Figure 2:
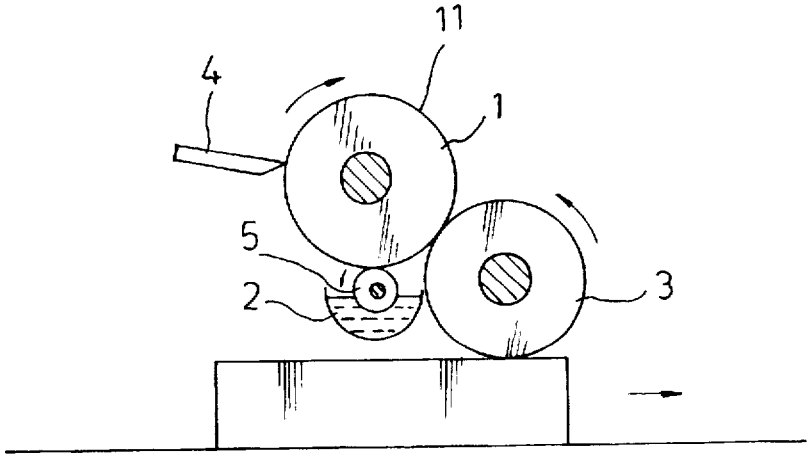
FIG. 2 is a schematic view illustrating the equipment for printing the pattern on the surface of an aluminum extrusion according to the present invention.

After the base color coating has been washed with the organic solvent, a predetermined pattern, such as wood grains, is printed onto base color coating of the aluminum extrusion by means of the printing device, as best illustrated in FIG. 2. The printing device has a power-driven metal roller 1 which has the wood grain pattern formed on an external face 11 thereof and which has ink 2 (or an acrylic coating) provided thereon by means of an ink application roller 5. A scraper 4 is provided adjacent to the metal roller 1 in order to remove excess ink from the external face 11 of the metal roller 1. The printing device further has a polyurethane roller 3 which contacts rotatably the external face 11 of the metal roller 1 and base color coating of the aluminum extrusion for transfer printing the wood grain pattern from the metal roller 1 onto the base color coating of the aluminum extrusion.

Finally, a transparent protective film is formed on the printed surface of the aluminum extrusion by applying an ultraviolet coating onto the printed surface of the aluminum extrusion and radiating ultraviolet light onto the ultraviolet coating in order to harden the ultraviolet coating.

In addition, the method for forming a pattern on the surface of the aluminum extrusion further comprises the step of washing the aluminum extrusion with water before each of the steps of forming the film on the cleaned surface of the aluminum extrusion, forming the base color coating on the surface of the aluminum extrusion, and baking aluminum extrusion in order to clean positively the surface of the aluminum extrusion.

Alternatively, the base color coating may be provided onto the surface of the aluminum extrusion by electroplating the aluminum extrusion in a mixture solution of 2–30 g/l stannous sulfate, 5–90 g/l nickel sulfate and 2–30 g/l sulfuric acid by means of an alternating current of 5–30 volts.

Furthermore, a synthetic film may be formed on the cleaned surface of the aluminum extrusion instead of the oxide film by dipping the aluminum extrusion in a chromate solution, and the base color coating may be provided onto the surface of the aluminum extrusion by powder-coating an epoxy resin or polyethylene coating on the surface of the aluminum extrusion.

Moreover, the transparent protective film may be formed on the printed surface of the aluminum extrusion by applying an acrylic coating on the surface of the aluminum extrusion, and baking the acrylic coating.

Furthermore, in the step of forming the pattern on the surface of the aluminum extrusion, the printing device may comprise a plurality of metal rollers and polyurethane rollers for printing a plurality of sets of patterns onto the surface of the aluminum extrusion. The metal and polyurethane rollers may be disposed around the entire surface of the aluminum extrusion in order to improve the printing efficiency.

I claim:

1. A method for forming a pattern on a surface of an aluminum extrusion, said method comprising the steps of:

cleaning said surface of said aluminum extrusion by degreasing, caustic washing and pickling said aluminum extrusion;

forming a film on said cleaned surface of said aluminum extrusion;

providing a base color coating on said surface of said aluminum extrusion;

baking said aluminum extrusion at a temperature of 150°–300° C. in order to crosslink and harden said base color coating;

washing said base color coating on said surface of said aluminum extrusion with an organic solvent in order to remove oil stains and dust;

printing said pattern onto said base color coating on said surface of said aluminum extrusion by means of a power-driven metal roller which has said pattern formed on an external face thereof and which has ink provided thereon, and a polyurethane roller which contacts rotatably said external face of said metal roller and said base color coating on said surface of said aluminum extrusion for transfer printing said pattern from said metal roller to said base color coating of said aluminum extrusion; and forming a transparent protective film on said printed surface of said aluminum extrusion.

2. The method for forming a pattern on a surface of an aluminum extrusion as claimed in claim 1, wherein said pattern is in the form of wood grains.

3. The method for forming a pattern on a surface of an aluminum extrusion as claimed in claim 1, wherein the steps of said method are performed continuously on a conveyor device.

4. The method for forming a pattern on a surface of an aluminum extrusion as claimed in claim 1, wherein the step of providing said base color coating on said surface of said aluminum extrusion comprises electrodepositing an electrodeposition coating of a base color on said surface of said aluminum extrusion at a temperature of 0°–50° C., the concentration of said electrodeposition coating being 1–25 wt %.

5. The method for forming a pattern on a surface of an aluminum extrusion as claimed in claim 1, wherein the step of providing said base color coating on said surface of said aluminum extrusion comprises electroplating said aluminum extrusion in a mixture solution of 2–30 g/l stannous sulfate, 5–90 g/l nickel sulfate and 2–30 g/l sulfuric acid by means of an alternating current of 5–30 volts.

6. The method for forming a pattern on a surface of an aluminum extrusion as claimed in claim 1, wherein the step of forming a film on said cleaned surface of said aluminum extrusion includes the step of electrolyzing said aluminum extrusion in a sulfuric acid solution in order to form an oxide film on said surface of said aluminum extrusion, said sulfuric acid solution containing sulfuric acid having a concentration of 50–250 g/l, an aluminum ion concentration of 2–50 g/l, an electrolysis temperature of 10°–30° C., an electrolysis voltage of 5–25 volts, and an electric current density of 50–300 A/m$^2$.

7. The method for forming a pattern on a surface of an aluminum extrusion as claimed in claim 1, wherein the step of forming a film on said cleaned surface of said aluminum extrusion includes the step of dipping said aluminum extrusion in a chromate solution in order to form a synthetic film.

8. The method for forming a pattern on a surface of an aluminum extrusion as claimed in claim 7, wherein the step of providing a base color coating on said surface of said aluminum extrusion includes the step of powder-coating an epoxy resin coating on said surface of said aluminum extrusion.

9. The method for forming a pattern on a surface of an aluminum extrusion as claimed in claim 7, wherein the step of providing a base color coating on said surface of said aluminum extrusion includes the step of powder-coating a polyethylene coating on said surface of said aluminum extrusion.

10. The method for forming a pattern on a surface of an aluminum extrusion as claimed in claim 1, wherein said ink (2) in the step of printing said pattern onto said surface of said aluminum extrusion includes an acrylic coating.

11. The method for forming a pattern on a surface of an aluminum extrusion as claimed in claim 1, further comprising the step of washing said aluminum extrusion with water before each of the steps of forming said film on said cleaned surface of said aluminum extrusion, forming said base color coating on said surface of said aluminum extrusion, and baking said aluminum extrusion.

12. The method for forming a pattern on a surface of an aluminum extrusion as claimed in claim 1, wherein the step of forming said transparent protective film on said surface of said aluminum extrusion includes the step of applying an ultraviolet coating onto said printed surface of said aluminum extrusion, and radiating ultraviolet light onto said ultraviolet coating in order to harden said ultraviolet coating.

13. The method for forming a pattern on a surface of an aluminum extrusion as claimed in claim 1, wherein the step of forming said transparent protective film on said surface of said aluminum extrusion includes the steps of applying an acrylic coating on said surface of said aluminum extrusion, and baking said acrylic coating.

* * * * *